US006349187B2

(12) United States Patent
Hayashi

(10) Patent No.: US 6,349,187 B2
(45) Date of Patent: Feb. 19, 2002

(54) IMAGE FORMING APPARATUS

(75) Inventor: Yasuhiro Hayashi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/750,163

(22) Filed: Dec. 29, 2000

(30) Foreign Application Priority Data

Jan. 7, 2000 (JP) ..... 2000-001467

(51) Int. Cl.[7] ..... G03G 15/20
(52) U.S. Cl. ..... 399/70; 399/320
(58) Field of Search ..... 399/70, 69, 67, 399/320, 328, 43; 219/216, 619

(56) References Cited

U.S. PATENT DOCUMENTS 6,298,213 B1 * 10/2001 Miyamoto et al. ..... 399/320

FOREIGN PATENT DOCUMENTS

JP 10-171296 6/1998

JP 11-133803 * 5/1999

* cited by examiner

*Primary Examiner*—Sophia S. Chen
(74) *Attorney, Agent, or Firm*—Fitzpatrick, Cella, Harper & Scinto

(57) ABSTRACT

The present invention provides an image forming apparatus that has unfixed image forming device for forming an unfixed image based on an image formation start signal, and fixing device for fixing the unfixed image, formed by the unfixed image forming device, on a recording material, wherein the fixing device includes a rotating member and magnetic flux generating device for generating a magnetic flux by supplying power, wherein the magnetic flux generated by the magnetic flux generating device generates an eddy current in the rotating member, so that the rotating member generates heat, thereby an image on the recording material is heated, and wherein, in a stand-by state prior to an input of the image formation start signal, a rotation of the rotating member is stopped and the magnetic flux generating device is energized.

5 Claims, 7 Drawing Sheets

IMAGE FORMING APPARATUS

BACKGROUND OF THE INVENTION

1. Field of the Invention

The present invention relates to an image forming apparatus such as a copying apparatus, a printer or the like, and more particularly to an apparatus employing fixing means provided with a rotating member heated by induction heating.

2. Related Background Art

The image forming apparatus based on the electrophotographic process is provided with a fixing device for fusion fixing toner to a transfer material, by applying heat and pressure while sandwiching and conveying the transfer material and the toner, borne on the transfer material and composed of a resinous material, a magnetic material, a coloring material etc. in a pressure contact portion (nip portion) of a fixing roller and a pressure roller maintained in mutual pressurized contact and in rotation.

In such fixing device, there is proposed, as heating means, a method of generating an eddy current in an electroconductive layer provided on the fixing roller by means of a magnetizing coil thereby generating Joule heat. The method allows to position the heat source very close to the toner, thereby being featured in shortening the time required by the surface temperature of the fixing roller to reach a temperature adequate for fixing at the start-up of the fixing device, in comparison with the conventional heat roller system employing a halogen lamp. It is also featured by a high heat efficiency because of the short and simple heat transmission path from the heat source to the toner.

In such fixing device to the induction heating type, it is preferable to heat the fixing roller in the stand-by state in order to further expedite the starting of the device, but the rotation of the fixing roller in such state is not desirable in consideration of the heat efficiency because such rotation induces wasted heat radiation from the fixing roller constituting the heat source.

SUMMARY OF THE INVENTION

An object of the present invention is to provide an image forming apparatus capable of efficiently warming the rotating member of the fixing means.

Another object of the present invention is to provide an image forming apparatus provided with unfixed image forming means for forming an unfixed image based on an image formation start signal, and fixing means for fixing the unfixed image formed by the unfixed image forming means on a recording material, wherein the fixing means includes a rotating member and a magnetic flux generating means for generating a magnetic flux by supplying power, wherein the magnetic flux generated by the magnetic flux generating means generates an eddy current in the rotating member, so that the rotating member generates heat by the eddy current, thereby an image on the recording material is heated, and wherein, in a stand-by state prior to an input of the image formation start signal, the rotating member stops rotation and the magnetic flux generating means is energized.

Still other objects of the present invention, and the features thereof, will become fully apparent from the following description.

DETAILED DESCRIPTION OF THE PREFERRED EMBODIMENTS

Now the present invention will be clarified in detail by embodiments thereof, with reference to the accompanying drawings.

Figure 7:
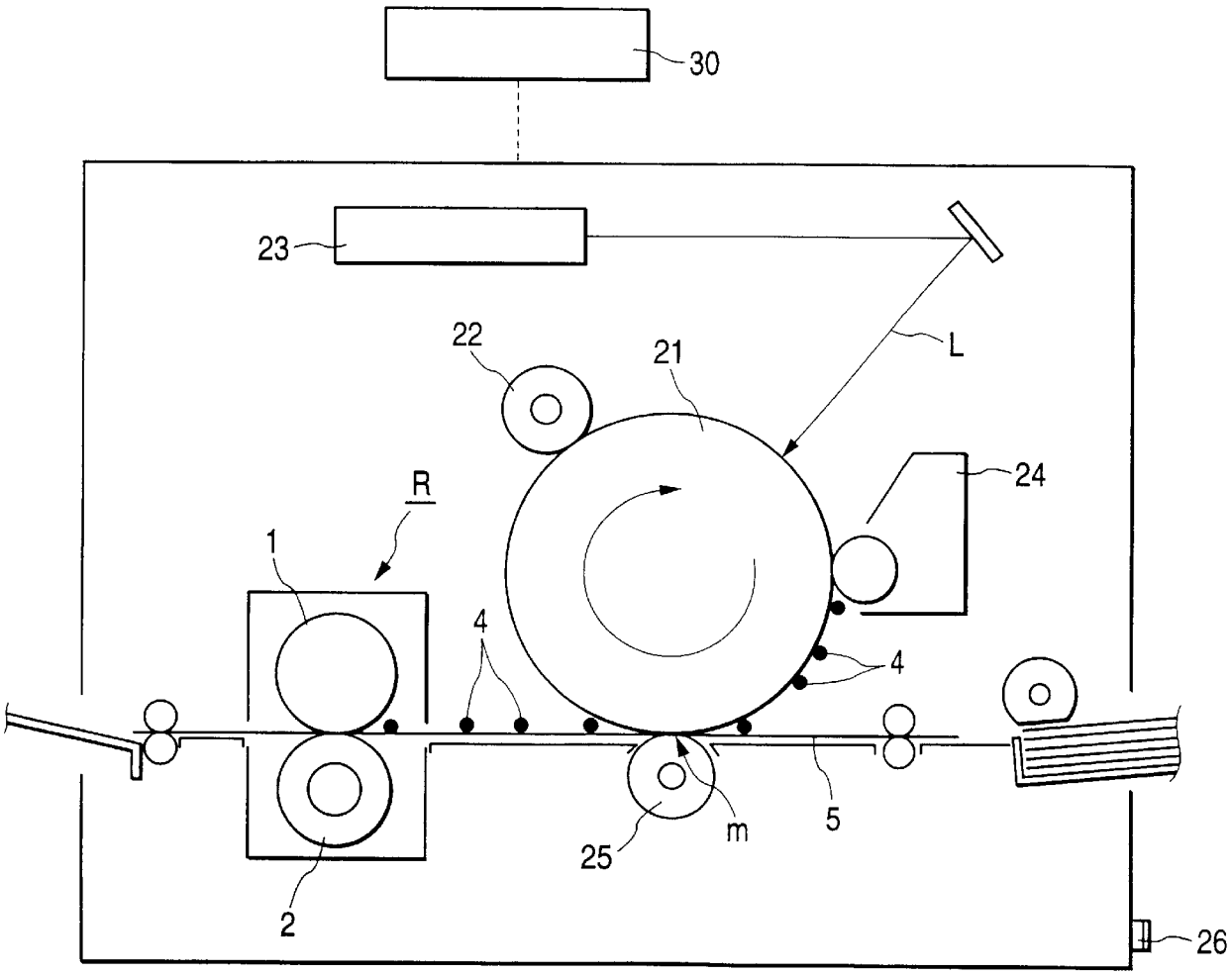
FIG. 7 is a schematic view showing the image forming apparatus that is an embodiment of the present invention.

FIG. 7 is a schematic view showing the configuration of an image forming apparatus embodying the present invention. The image forming apparatus of the present embodiment is a laser beam printer utilizing an electrophotographic process.

The reference numeral 30 shows a host apparatus such as an image reading apparatus, a word processor, or a computer. An image formation start signal (print signal) is inputted to the image forming apparatus.

An electrophotographic photosensitive member (hereinafter represented as photosensitive drum) 21 of rotating drum type, serving as an image bearing member, is rotated clockwise, as indicated by an arrow, with a predetermined peripheral speed (process speed) and, in the source of such rotation, uniformly charged to a predetermined negative dark potential $V_D$ by a primary charger 22.

A laser beam scanner 23 outputs a laser beam L modulated according to a time-sequential digital electric image signal of the desired image information inputted from the host apparatus 30, thereby exposing in scanning the uniformly charged surface of the rotating photosensitive drum 21.

By such scanning exposure with the laser beam, the exposed portion in the uniformly charged surface of the rotating photosensitive drum 21 assumes a light portion potential $V_L$ with a smaller absolute value, whereby an electrostatic latent image corresponding to the desired image information is formed on the surface of the rotating photosensitive drum 21.

The latent image is then subjected to reversal development in a developing device 24 with negatively charged powder toner (toner being deposited in the laser exposed portion of the light portion potential $V_L$ on the photosensitive drum surface), thereby being visualized as a toner image 4.

On the other hand, sheet 5 constituting the recording material and fed from a sheet feeding tray is conveyed, with an appropriate timing synchronized with the rotation of the photosensitive drum 21, to the pressure contact nip portion (transfer portion) m between the photosensitive drum 21 and the transfer roller 25 constituting a transfer member to which a transfer bias is supplied, whereby the toner image 4 formed on the photosensitive drum 21 is transferred in succession onto the surface of the sheet 5.

The sheet 5 bearing the unfixed toner image 4 which is formed by image forming means composed of the components 21, 22, 23, 24, 25 etc. is separated from the surface of the rotating photosensitive drum 21 then is introduced into a fixing apparatus (image heating apparatus) R for fixing the toner image 4, and is discharged as an image formed object (print) from the apparatus.

Figure 1:
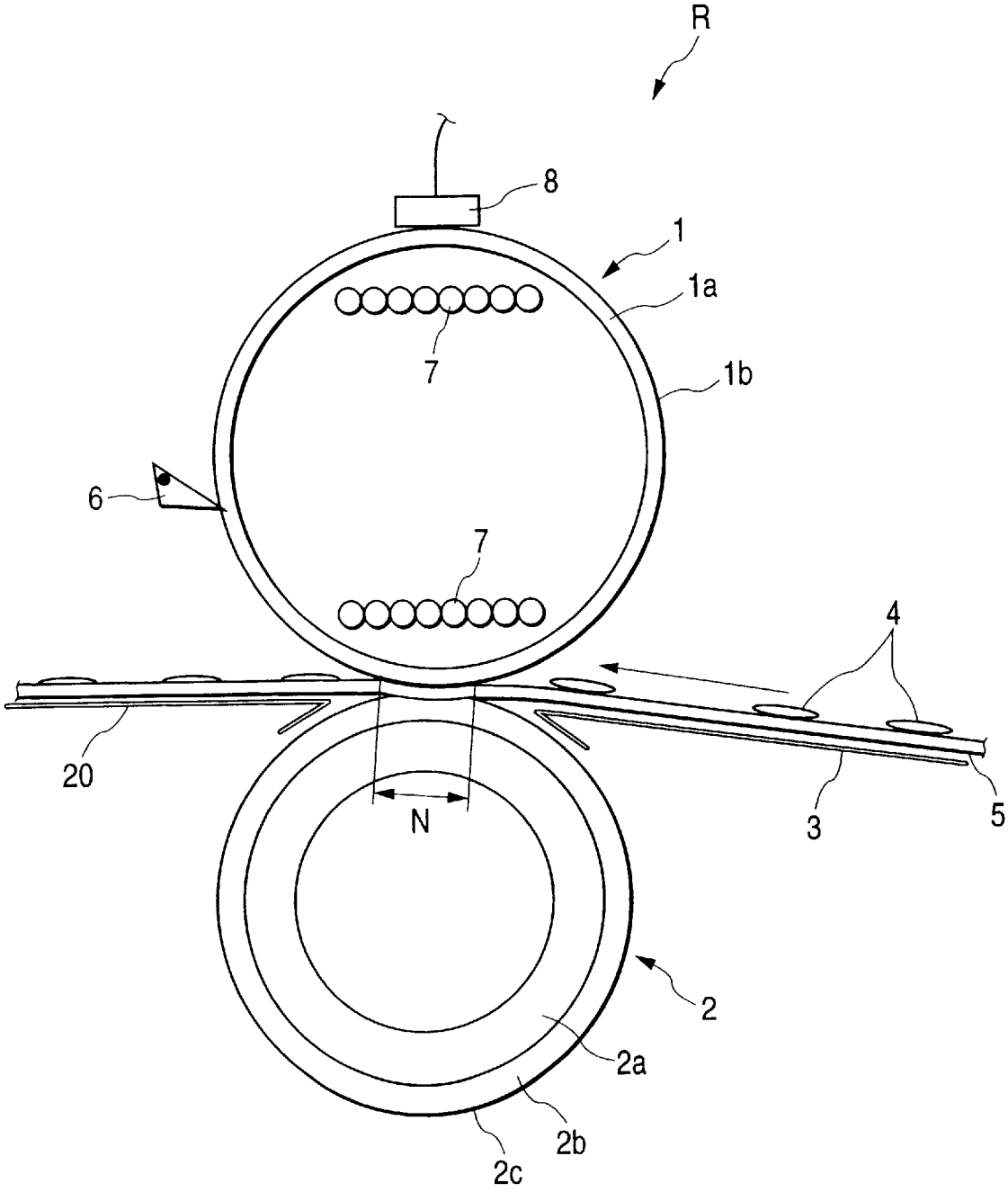
FIG. 1 is a cross-sectional views of a fixing device applicable to an image forming apparatus embodying the present invention.

FIG. 1 is a schematic cross-sectional view of the fixing apparatus R.

A fixing roller 1, which is a rotating member, is composed of a rigid cylindrical metal core 1*a* of iron with an external diameter of 30 mm and a thickness of 1.0 mm, and may be provided with a layer 1*b* of fluorinated resin such as PTFE of 10 to 50 $\mu$m or PFA of 10 to 50 $\mu$m, in order to improve the releasing property of the surface. The metal core 1*a* of the fixing roller 1 may also be composed of another material of a relatively high magnetic permeability $\mu$ and an appropriate resistivity ρ for example a magnetic material (magnetic metal) such as magnetic stainless steel. In any case, the metal core 1*a* of the fixing roller 1 is an electrically conductive layer.

The pressure roller 2, constituting a back-up member, is composed of an iron core metal 2*a* of an external diameter of 20 mm with a silicone (Si) rubber layer 2*b* of a thickness of 5 mm on the external periphery, eventually with a fluorinated resin layer 2*c* for example of PTFE of 10 to 100 $\mu$m or PFA of 10 to 100 $\mu$m, with an entire external diameter of about 30 mm. The fixing roller 1 and the pressure roller 2 are rotatably supported, in which the fixing roller is driven. The pressure roller 2 is maintained in contact with the surface of the fixing roller 1 and is rotated by the friction at the pressure contact portion (nip portion) N. The pressure roller 2 is biased toward the rotary shaft of the fixing roller 1 by an unrepresented mechanism utilizing for example springs. The pressure roller 2 is pressured with a load of about 20 kgf (20×9.8=196N), thereby providing a nip width of about 6 mm. However the nip width may assume another value by varying the pressurizing load.

A conveying guide 3 is provided in such a position as to guide the sheet, conveyed while supporting the unfixed toner image 4, to the nip portion 4 between the fixing roller 1 and the pressure roller 2.

A separation claw 6 is positioned in contact with the surface of the fixing roller 1 and serves to forcedly separate the sheet 5 which eventually adheres to the fixing roller 1 after passing the nip portion, thereby preventing the sheet jamming.

Figure 2:
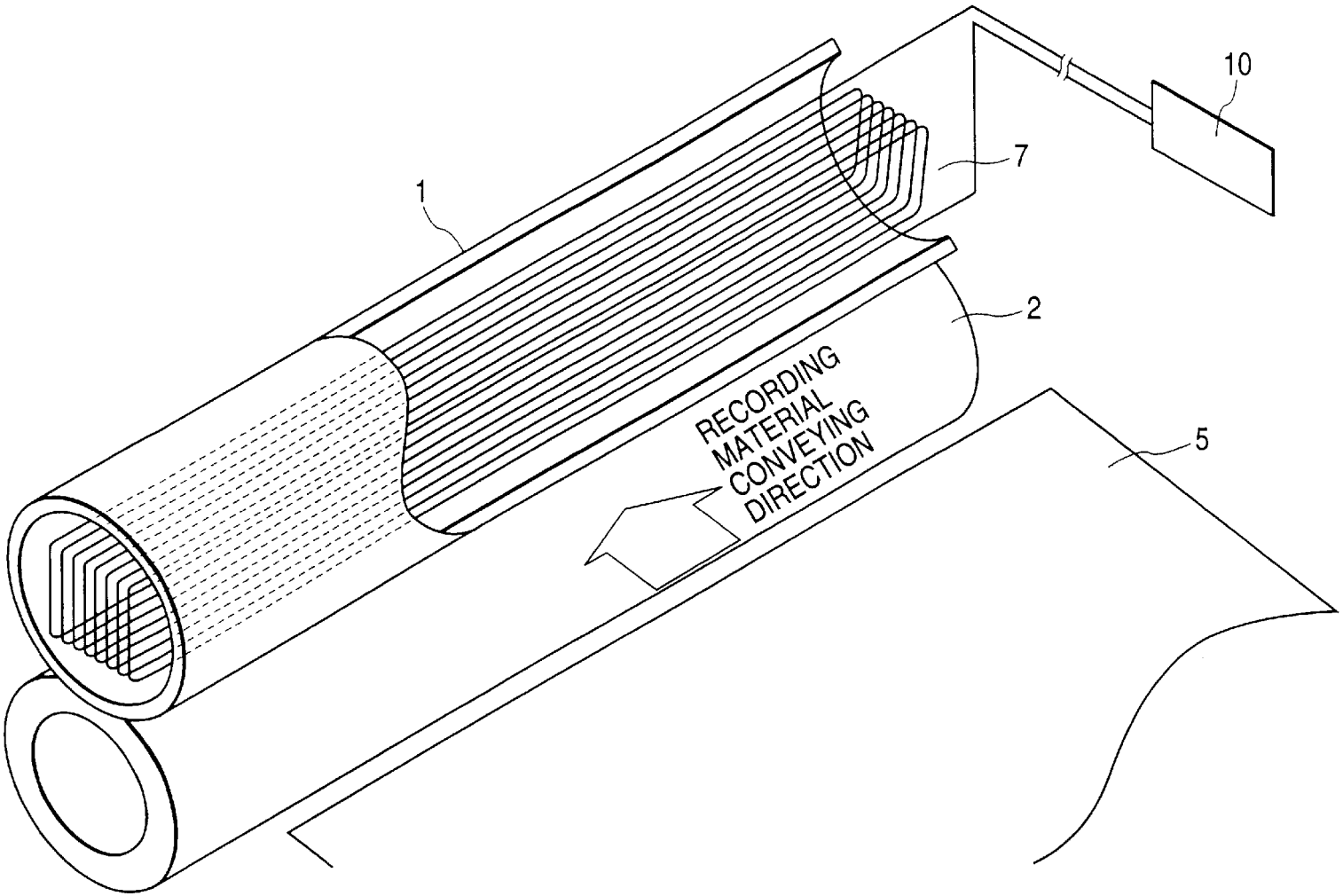
FIG. 2 is a perspective view of the fixing device, showing the arrangement of a magnetizing coil.

A magnetizing coil 7 is so wound, in the interior of the fixing roller 1 as shown in FIG. 2, over the longitudinal direction thereof, that a side of the coil is opposed to the nip portion, and is formed with eight turns in the present embodiment. The coil is composed of a litz wire consisting of a twisted bundle of 20 to 150 insulated conductive wires of an external diameter of 0.15 to 0.50 mm. The coil 7 is connected to a high frequency converter 10 capable of applying an AC current of 10 to 100 Khz, thereby receiving an electric power up to about 2000 W. There is employed heat-resistant insulation in consideration of the temperature rise in the magnetizing coil 7.

Figure 3:
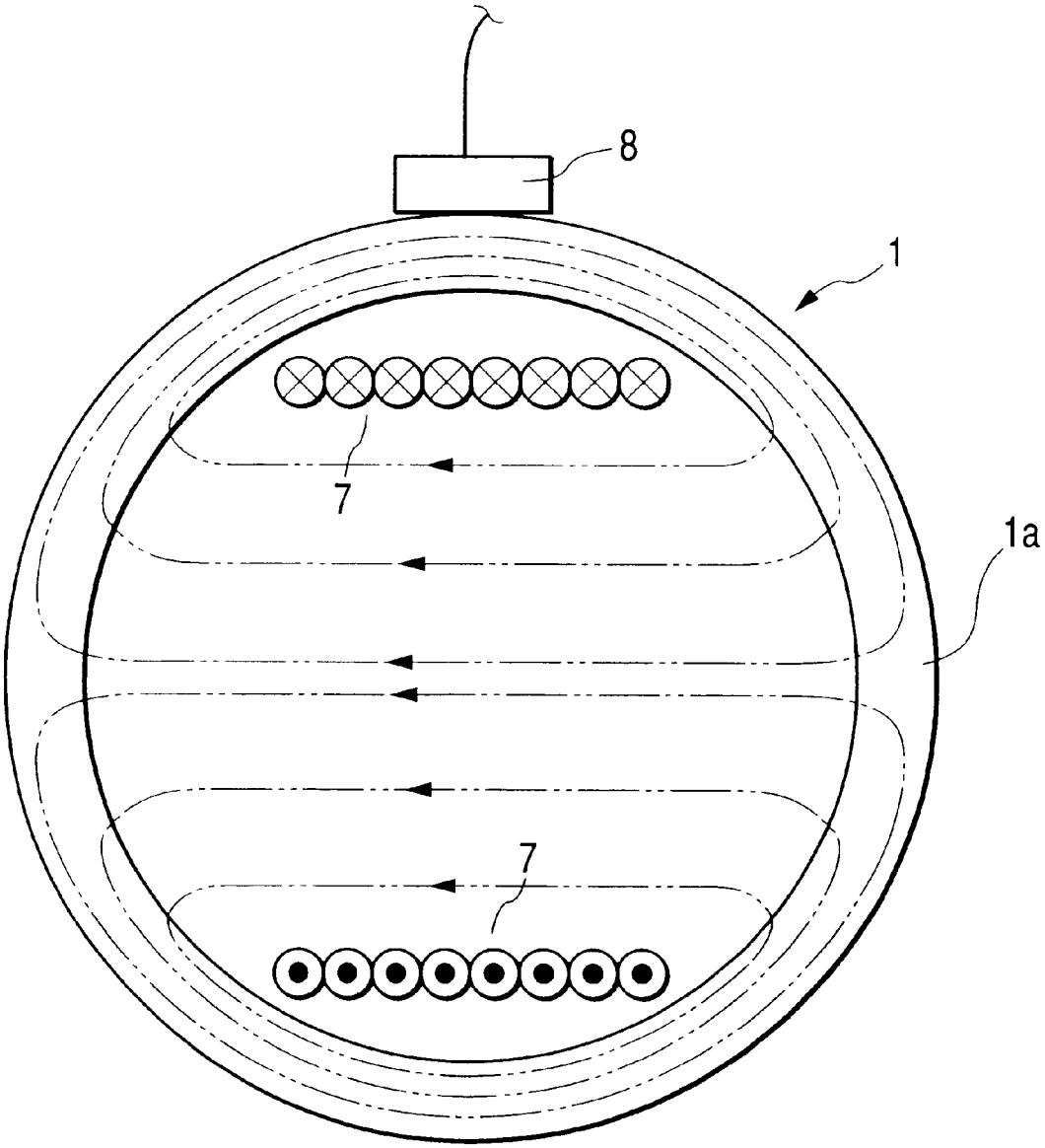
FIG. 3 is a view showing the principle of heat generation in the fixing roller.

The magnetizing coil 7, constituting the magnetic flux generating means, generates a magnetic field (magnetic flux) as indicated by chain lines in FIG. 3, by the AC current from the high frequency converter 10, thereby generating an eddy current in the conductive metal core 1*a* of the fixing roller 1 and thus generating Joule heat. The amount of generated heat may be increased by increasing the amplitude of the AC current.

A temperature sensor 8 is so provided as to contact a portion of the surface of the fixing roller 1 opposed to the magnetizing coil 7, and the surface temperature of the fixing roller 1 at the detecting position is automatically controlled to a target temperature of 190° C. (predetermined fixing set temperature set in advance) by adjusting the power supply to the magnetizing coil 7 based on the detection signal of the temperature sensor 8.

In the fixing device of the present embodiment with the above-described configuration, the fixing roller 1 is at first controlled to the target temperature by the AC current supplied from the high frequency converter 10. The rotation of the fixing roller 1 is started in response to the entry of a fixing start signal (namely image formation start signal), and, after a predetermined period required by the surface temperature of the fixing roller 1 to become uniform, the sheet 5 bearing the unfixed toner image 4 is introduced into the nip portion N whereby the unfixed toner image 4 is fixed (heat-processed) to the sheet 5 by the pressure of the nip portion N and the heat from the fixing roller 1. The sheet 5 is conveyed by the rotation of the fixing roller 1, and, after passing the nip portion N, is separated from the fixing roller and is discharged along a sheet discharge guide 20 to the exterior of the apparatus, whereby the process is completed.

In the following there will be explained the control in the stand-by state and in the fixing operation of the fixing device, featuring the present invention and allowing to expedite the start-up process and to prevent unevenness in the surface temperature of the fixing roller. In the present embodiment, there is executed a preparatory process (pre-process) of the apparatus after the power supply (main switch 26) of the apparatus is turned on, and, in a stand-by state of the fixing device from the end of the pre-process to the entry of the fixing start signal, the rotation of the fixing roller 1 is stopped. In such state, temperature control is executed by adjusting the electric power supplied to the magnetizing coil 7, based on the detection signal of the temperature sensor 8, in such a manner that the surface temperature of the fixing roller 1 at the detecting position of the temperature sensor 8 reaches 190° C.

In the present embodiment, as explained in the foregoing, the rotation of the fixing roller is stopped while the magnetizing coil is energized during the stand-by state of the apparatus, whereby it is rendered possible to prevent the metal core constituting the heat source from radiating by the rotation of the fixing roller, and to warm the fixing roller in the stand-by state without sacrificing the heat efficiency.

Figure 4:
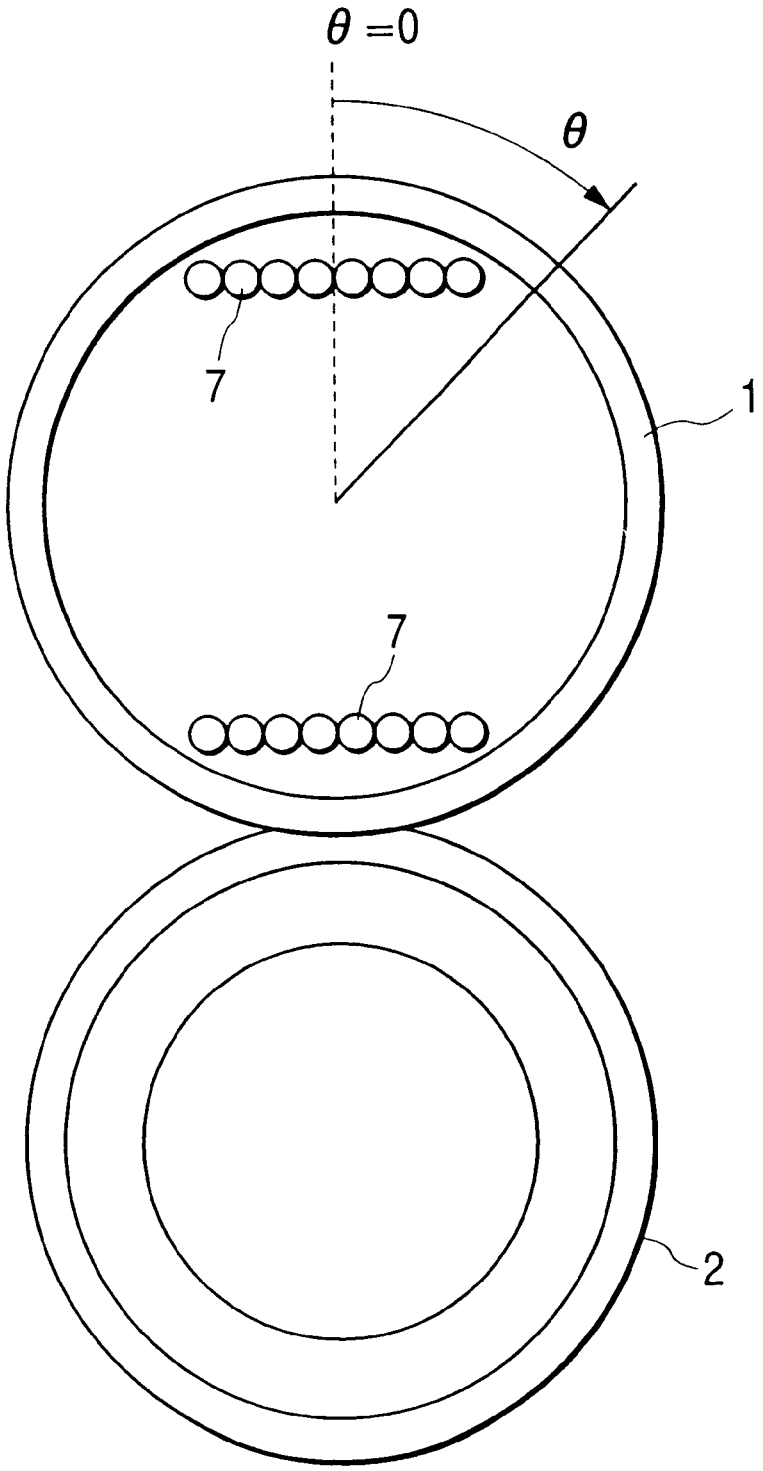
FIG. 4 is a view showing the position of the surface of the fixing roller.
Figure 5:
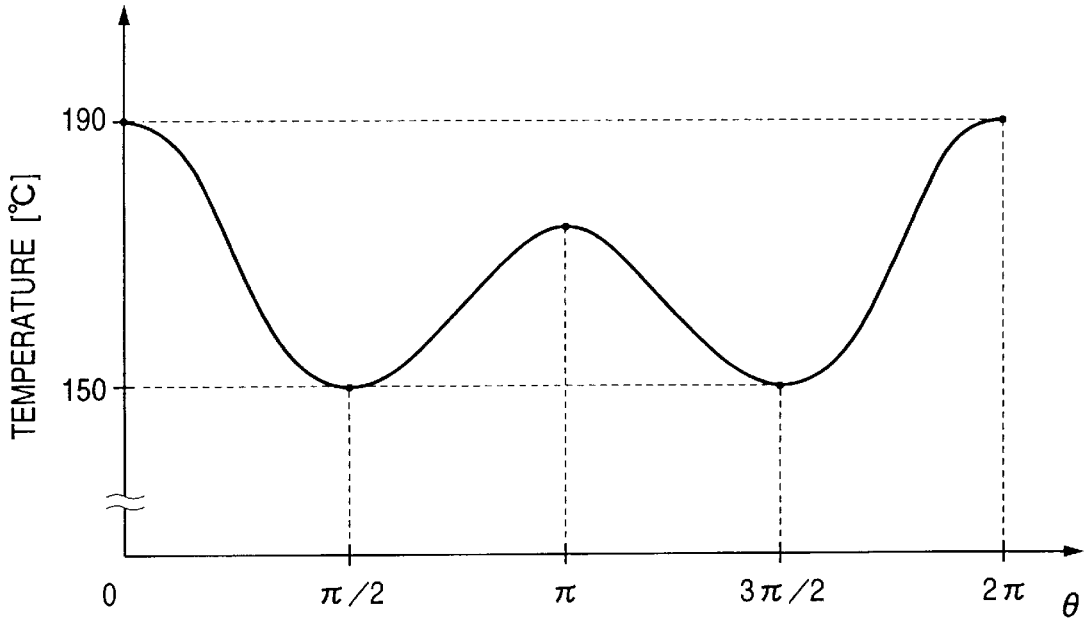
FIG. 5 is a chart showing the surface temperature of the fixing roller.

In the fixing device of induction heating type, in order to increase the efficiency of conversion of electric power into heat under a condition of a constant electric power, it is desirable to locally apply a strong magnetic flux to the metal core constituting the conductive layer. As a result, the heat generation on the fixing roller is limited to a local portion opposed to the magnetizing coil, whereby an unevenness in the temperature is generated along the periphery of the fixing roller while the rotation of the fixing roller is stopped. The surface temperature distribution in such state, along the periphery of the fixing roller 1, with reference to FIGS. 4 and 5. FIG. 4 represents the surface position of the fixing roller 1, in the longitudinal the surface position of the fixing roller 1, in the longitudinal cross section along the sheet conveying direction, by an angle θ is shown on the abscissa while the surface temperature in such position is shown on the ordinate. As shown in FIG. 5, the surface temperature of the fixing roller 1 is higher in positions (θ=0, π) opposed to the magnetizing coil 7 and is lower in positions (θ=π/2, 3π/2) not opposed to the magnetizing coil 7.

The measured temperature difference was 40° C. Thus, an unevenness in the luster will be generated in the fixed image if the fixing is immediately started. More specifically, the luster becomes higher or lower where the image respectively comes into contact with a portion of a higher surface temperature or that of a lower surface temperature of the fixing roller 1.

Figure 6:
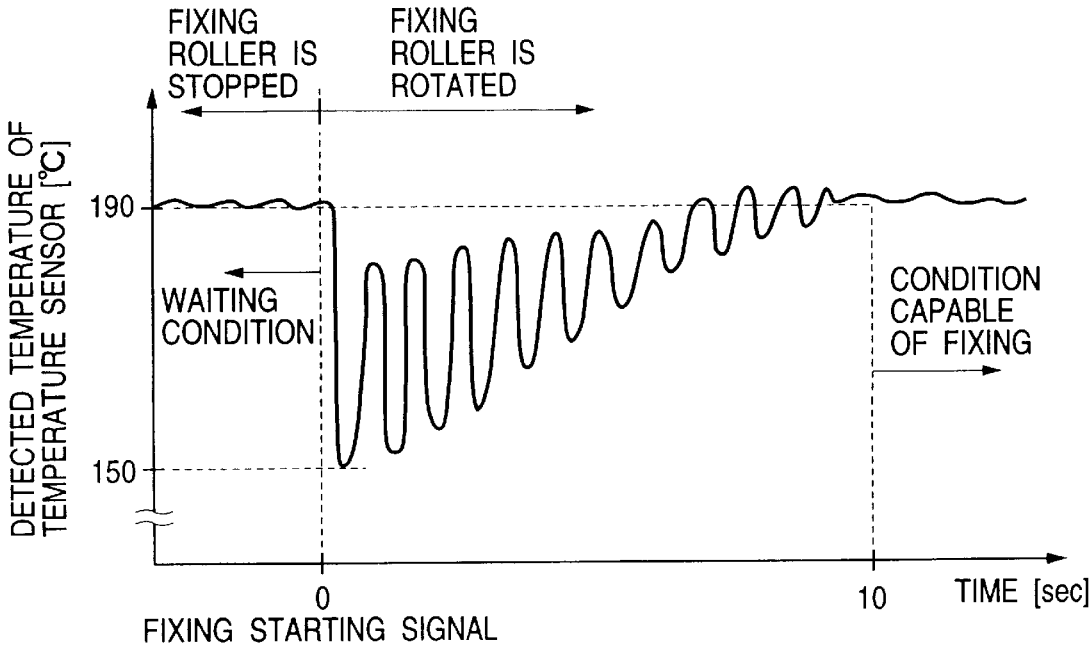
FIG. 6 is a chart showing the surface temperature of the fixing roller from a stand-by state to a state capable of fixing.

In the present embodiment, in order to resolve the above-mentioned drawback, the rotation of the fixing roller 1 is started simultaneous with the fixing start signal. FIG. 6 shows the temperature detected by the temperature sensor 8 in such state. As the temperature of the pressure roller 2 is lowered during the stand-by state, the temperature of the fixing roller 1 rapidly decreases after the start of rotation, but the surface temperature of the fixing roller 1 is uniformly restored to 190° C. within 10 seconds by a power input of 1000 W to the magnetizing coil 7. Consequently, a high-quality image without unevenness in the luster can be obtained by starting the fixing operation after the lapse of a predetermined period of 10 second from the fixing start signal. The above-mentioned period of 10 seconds is not restrictive and is variable according to the power input to the magnetizing coil 7, the heat capacity of the pressure roller, the ambient temperature etc.

Also the period required by the fixing roller to reach a uniform surface temperature is necessarily measured by the time as explained in the foregoing, and it is also possible to count the number of turns of the fixing roller (rotating member) and to start the fixing process after a predetermined number of count is reached.

In the present embodiment, as explained in the foregoing, the fixing roller is temperature controlled in the non-rotated state during the stand-by state of the fixing device, but it is temperature controlled under rotation for a predetermined period in response to the fixing start signal (image formation start signal), thereby providing a fixing device capable of achieving high image quality without unevenness in the luster while shortening the waiting time of the user.

Figure 8:
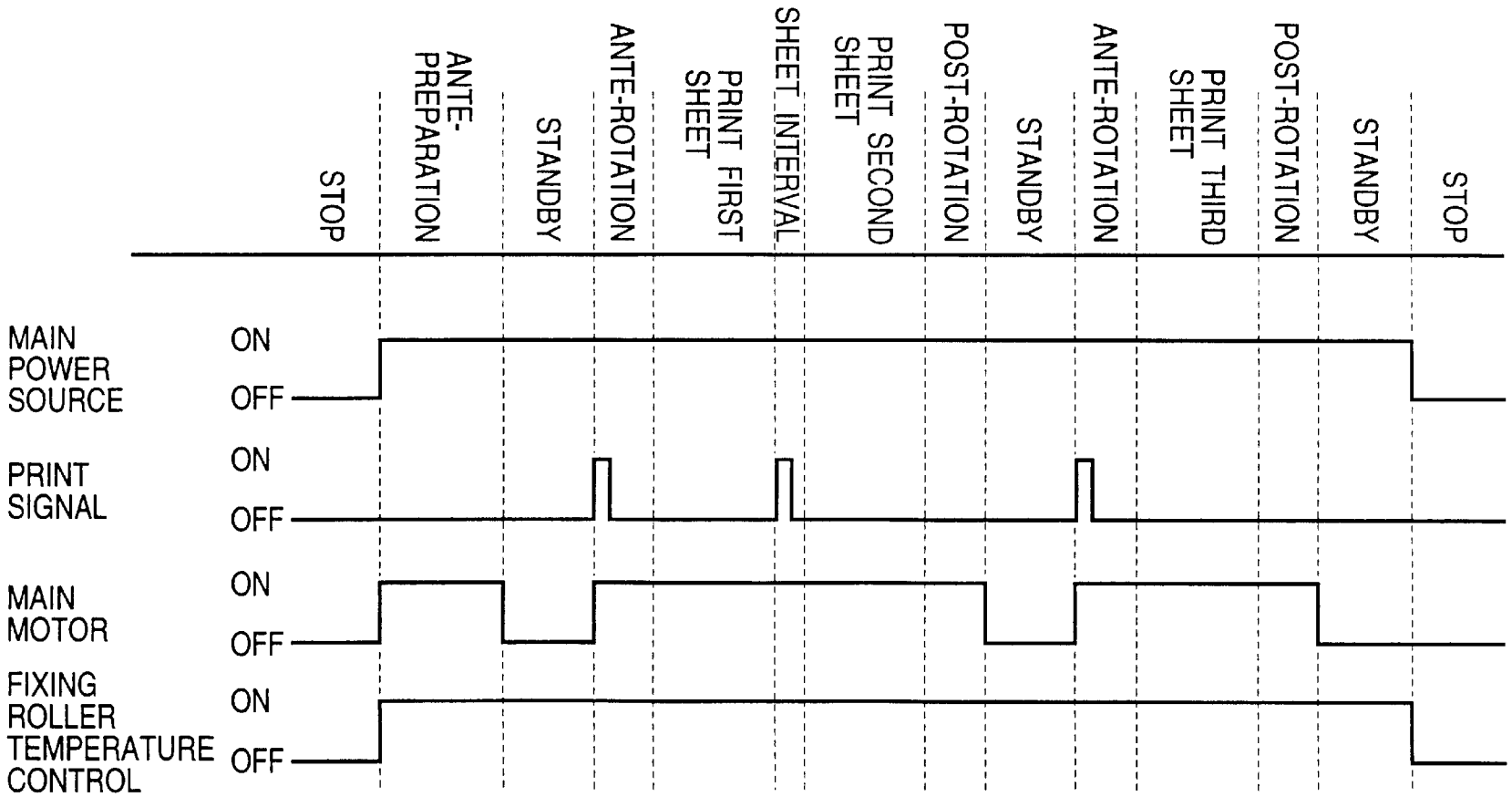
FIG. 8 is a view showing the function of the image forming apparatus.

FIG. 8 shows the timing of a certain image forming control in the present embodiment, illustrating a case of printing two sheets in succession after the start of power supply, then printing a third sheet after a pause and turning off the power supply.

When the main power supply of the apparatus is turned on, a main motor etc. are turned on the start a pre-rotation step for rotating the photosensitive drum 21, thereby executing a pre-process operation of the precess device such as the charging by a charging roller 22. After a predetermined pre-process operation, the main motor is stopped to maintain a stand-by (waiting) state until a print signal is inputted.

In response to the entry of a print signal, the main motor is re-activated to execute predetermined pre-print operations such as feeding of the sheet 5 in succession to the pre-process operation, the printing of the first sheet is executed by the charging, imagewise exposure and developing steps on the rotating photosensitive drum and the transfer and fixing steps on the sheet 5.

Then the printing of the second sheet is executed in a similar manner, and the sheets are thereafter completely discharged from the apparatus. After a post-rotation step, the apparatus turns off the main motor to enter the stand-by state until a next print signal is inputted.

Then, upon receiving a print signal for a third print, there are executed in succession a pre-rotation step, a third printing step and a post-rotation step, and the apparatus thereafter turns off the main motor to input the stand-by state.

When all the required printing operations are completed, the main power supply is turned off and all the operations are terminated.

In the present embodiment, the fixing roller 1 is linked with the main motor through unrepresented gears, and is rotated when the main motor is turned on. Also the temperature control of the fixing roller 1 is constantly executed while the main power supply is turned on. Thus, in the stand-by state of the image forming apparatus, the fixing roller 1 of the fixing apparatus R is temperature controlled while it is stopped. In response to the reception of the print signal (fixing signal), the image fixing is started after the fixing roller is rotated (pre-rotation) for the predetermined period, and, after the completion of such fixing process, the apparatus turns off the rotation of the fixing roller 1 to enter the stand-by state again.

In the present embodiment, as explained in the foregoing, the temperature control of the fixing roller 1 is continued but the rotation thereof is stopped during the stand-by state thereby reducing the time required from the reception of the print signal to the state of the fixing operation. It is also rendered possible to eliminate the unevenness in the luster of the image resulting from the unevenness in the surface temperature of the fixing roller, by rotating the fixing roller for a predetermined period from the reception of the print signal to the start of fixing operation.

Also in the foregoing embodiment, the fixing roller 1 in the stand-by state is controlled at a temperature same as that in the fixing operation (namely in the heat treating operation), but the present invention is not limited to such embodiment and the fixing roller may be controlled at such a temperature that can be elevated within a predetermined time to a temperature allowing the heat treatment. For example, the fixing roller may be controlled during the stand-by state at a temperature about a half of the fixing temperature, as long as the fixing roller can be brought to a uniform surface temperature within the time required for other process steps such as the pre-exposure of the photosensitive drum and the feeding of the sheet. Also the fixing roller may be controlled during the stand-by state at a temperature higher than that in the fixing operation, in anticipation of the temperature decrease at the start of rotation of the fixing roller.

The foregoing embodiment has been explained by a printer, but, in case the image forming apparatus is composed of a copying apparatus, the image formation start signal is a signal generated by the depression of a copy button.

The present invention has been explained by embodiments thereof,but the present invention is by no means limited by such embodiments and is subjected to various modifications and alterations within the scope and spirit of the appended claims.

What is claimed is:

1. An image forming apparatus comprising:

unfixed image forming means for forming an unfixed image based on an image formation start signal; and fixing means for fixing the unfixed image, formed by said unfixed image forming means, on a recording material;

wherein said fixing means includes a rotating member and magnetic flux generating means for generating a magnetic flux by supplying power, wherein the magnetic flux generated by said magnetic flux generating means generates an eddy current in said rotating member, so that said rotating member generates heat, thereby an image on the recording material is heated, and wherein, in a stand-by state prior to an input of said image formation start signal, a rotation of said rotating member is stopped and said magnetic flux generating means is energized.

2. An image forming apparatus according to claim 1, wherein, after the input of the image formation start signal, said rotating member is rotated for a predetermined period.

3. An image forming apparatus according to claim 1, wherein said stand-by state is a state after a preparatory operation of said apparatus is completed after a power supply therefor is turned on.

4. An image forming apparatus according to claim 1, wherein said rotating member is a rigid roller.

5. An image forming apparatus according to claim 1, further comprising a back-up member forming a nip with said rotating member, wherein said nip sandwiches and conveys the recording material bearing the unfixed image and fixed the unfixed image to the recording material.

* * * * *

UNITED STATES PATENT AND TRADEMARK OFFICE

CERTIFICATE OF CORRECTION

PATENT NO. : 6,349,187 B2
DATED : February 19, 2002
INVENTOR(S) : Yasuhiro Hayashi It is certified that error appears in the above-identified patent and that said Letters Patent is hereby corrected as shown below:

Column 1,
Line 65, "views" should read -- view --.

Column 5,
Line 28, "second" should read -- seconds --.
Line 40, "count" should read -- counts --.
Line 56, "the" should read -- at the --.

Column 7,
Line 3, "subjected" should read -- subject --.
Line 18, "thereby" should read -- whereby --.

Column 8,
Line 17, "fixed" should read -- fixes --.

Signed and Sealed this

Twenty-first Day of May, 2002

*Attest:*

*Attesting Officer*

JAMES E. ROGAN
*Director of the United States Patent and Trademark Office*